US005289238A

United States Patent [19]

Lior et al.

[11] Patent Number: 5,289,238

[45] Date of Patent: Feb. 22, 1994

[54] LIQUID TONER DEVELOPING APPARATUS HAVING METAL BLADE WITH INSULATING COATING IN CONTACT WITH DEVELOPING ROLLER

[75] Inventors: Ishaiau Lior, Nes Ziona; Itzhak Ashkenazi, Rehovot, both of Israel

[73] Assignee: Spectrum Sciences B.V., Wassenaar, Netherlands

[21] Appl. No.: 755,458

[22] Filed: Sep. 5, 1991

[51] Int. Cl.[5] ..... G03G 15/10

[52] U.S. Cl. ..... 355/256; 118/651

[58] Field of Search ..... 355/256, 257, 258, 261; 118/651, 659, 660, 661, 662

[56] References Cited

U.S. PATENT DOCUMENTS

| | | | |
|---|---|---|---|
| 3,728,016 | 4/1973 | Harbour, Jr. et al. | 355/296 |
| 3,910,231 | 10/1975 | Inoue et al. | 355/259 |
| 3,980,404 | 9/1976 | Townsend | 355/256 |
| 4,023,968 | 5/1977 | Amidon et al. | 355/257 X |
| 4,024,838 | 5/1977 | Horie | 118/661 |
| 4,043,657 | 8/1977 | Karnik | 355/256 |
| 4,259,003 | 3/1981 | Mangal et al. | 355/210 |
| 4,264,191 | 4/1981 | Gerbasi et al. | 355/299 |
| 4,325,627 | 4/1982 | Swidler | 118/661 X |
| 4,327,664 | 5/1982 | Ohkawa et al. | 118/661 |
| 4,400,079 | 8/1983 | Landa | 355/256 |
| 4,413,049 | 11/1983 | Beaudet et al. | 430/126 |
| 4,454,833 | 6/1984 | McChesney et al. | 355/256 X |
| 4,496,236 | 1/1985 | Beaudet et al. | 118/661 X |
| 4,648,704 | 3/1987 | O'Leary | 355/256 |
| 4,684,238 | 8/1987 | Till et al. | 355/256 X |
| 4,755,847 | 7/1988 | Matsushiro et al. | 355/261 X |
| 4,839,688 | 6/1989 | Bares | 355/253 |
| 4,974,027 | 11/1990 | Landa et al. | 355/256 |
| 4,985,732 | 1/1991 | Landa et al. | 355/256 |
| 4,992,832 | 2/1991 | Watanabe et al. | 355/259 |
| 5,117,263 | 5/1992 | Adam et al. | 355/256 |

FOREIGN PATENT DOCUMENTS

| | | | |
|---|---|---|---|
| 366426 | 5/1990 | European Pat. Off. . | |
| 0235977 | 9/1989 | Japan | 355/256 |
| 1443128 | 7/1976 | United Kingdom . | |
| 9004216 | 4/1990 | World Int. Prop. O. . | |
| 9014619 | 11/1990 | World Int. Prop. O. . | |

OTHER PUBLICATIONS

Fink et al., Standard Handbook for Electrical Engineers, pp. 4–179–180, 1978.

Xerox Disclosure Journal vol. 13 No. 3 May/Jun. 1988.

Xerox Disclosure Journal vol. 13 No. 6 Nov./Dec.

*Primary Examiner*—A. T. Grimley

*Assistant Examiner*—Robert Beatty

*Attorney, Agent, or Firm*—Sandler Greenblum & Bernstein

[57] ABSTRACT

Imaging apparatus including an imaging surface having a latent image with image areas at a first electrical potential and background areas at a second electrical potential and a developer. The developer includes a moving developer electrode electrified to a third electrical potential intermediate the first and second electrical potentials and has sequential surface portions closely spaced from the imaging surface to form a development region. The latent image is developed at the development region with liquid toner including carrier liquid and charged toner particles. Toner particles are also attracted to the developer surface and a resilient metal blade is urged against and in contact with the developer surface after it passes the development region and is operative to remove toner particles from the developer surface. The blade is coated with an insulating coating over at least a portion of the blade not contacting the developer surface. The developer electrode may be coated with an insulating coating and the blade may be electrified to a voltage having a polarity the same as that of the toner particles.

15 Claims, 3 Drawing Sheets

LIQUID TONER DEVELOPING APPARATUS HAVING METAL BLADE WITH INSULATING COATING IN CONTACT WITH DEVELOPING ROLLER

FIELD OF THE INVENTION

The present invention relates generally to liquid toner imaging apparatus and more particularly to developers for such apparatus.

BACKGROUND OF THE INVENTION

Various liquid toner electrostatic imaging systems providing single color or multicolor images, appear in the patent literature. Such systems often comprise a photoconductive surface which is electrically charged and then selectively discharged by the action of incident light so as to form a latent electrostatic image. The latent image is then developed by sequential applications of liquid toners of selectable colors to the imaging surface. Liquid toners generally comprise carrier liquid in which charged toner particles are dispersed.

In some systems using liquid toners, moving developer electrodes having electrically conductive surfaces such as metal endless belts or rollers are employed. A portion of the electrode is closely spaced from the imaging surface so as to form a development region therewith to enhance the electrostatic field at the imaging surface and transport excess carrier liquid and toner particles out of the development region.

U.S Pat. No. 4,400,079 to Landa describes a developing system utilizing a roller electrode having a conductive outer surface, a portion of which is closely spaced from the imaging surface. The roller is at least partly immersed in a pool of liquid developer. In one embodiment of the invention, the hydrodynamic force of the layer of developing liquid formed on the roller is utilized to space the roller the required distance from the imaging surface. In another embodiment, mechanical spacing means, such as a pair of spacing rollers, is used to maintain the spacing of the roller from the imaging surface. The patent also indicates the possibility of providing a thin insulating layer on the conductive surface of the developing roller electrode to avoid intimate electrical contact with the background regions of the image areas, apparently useful when no mechanical spacing means is provided. A foam wiper pad mounted against the surface of the electrode is used to remove toner deposits therefrom.

In some systems employing metallic developer electrode surfaces, used toner particles adhering to the developer electrode are removed therefrom downstream of the development region by one or more resilient blades which engage the cylindrical surface of the developer roller. U.S. Pat. No. 4,454,833 has a single doctor blade made of flexible material such as urethane or Mylar, mounted against a portion of an applicator roll which is partly submerged in liquid developer. U.S. Pat. No. 3,910,231 describes a system for removing used toner from a drum or belt including blades secured to rotatable shafts and disposed for operation in response to each color.

SUMMARY OF THE INVENTION

The present inventors have found that when a system of metal blades is employed to remove undeveloped liquid toner from the developer electrode, agglomerations of undeveloped toner particles or "sludge" may form on the blade surfaces. Consequently, it is an object of the present invention to provide single color or multicolor electrostatic liquid toner imaging apparatus with reduced sludge formation within the developer assembly of such apparatus. More specifically, the present invention provides, in a preferred embodiment thereof, developing apparatus having a cleaning assembly including a system of one or more sludge inhibiting, resilient blades operatively associated with the developer electrode. Used toner particles are removed efficiently from the surface of the developer electrode and preferably transported to used toner collection apparatus without accumulation of liquid toner residues or sludge on the blade surfaces. The present invention thereby provides, in a preferred embodiment, electrographic imaging apparatus combining a clean, relatively maintenance free developer assembly with excellent imaging performance.

There is therefore provided, in accordance with a preferred embodiment of the invention, electrostatic imaging apparatus for use with liquid toners, the apparatus including:

an imaging surface;

apparatus for forming, on the imaging surface, a latent image comprising image areas at a first electrical potential and background areas at a second electrical potential; and developing apparatus for developing the latent image with a liquid toner including charged toner particles and a carrier liquid, the developing apparatus including a developer roller having an insulating surface layer, and being electrified to a third electrical potential intermediate the first and second electrical potentials and having a portion closely spaced from the imaging surface to form a development region therebetween, whereat the latent image is developed with the liquid toner.

In accordance with a preferred embodiment of the invention, the insulating surface layer on the developer roller includes a hard abrasion resistant surface coating of anodized aluminum treated to enhance its electrical insulation properties. Preferably, the hard abrasion resistant surface coating of anodized aluminum is impregnated with a material consisting essentially of a chemical compound of a Group II or Group III metal with a long chain fatty acid. In an alternative preferred embodiment of the invention, the developer roller insulating surface layer includes a nitrocellulose coating.

In accordance with a preferred embodiment of the invention, toner particles are attracted to the developer roller of the developing apparatus, which further includes removal apparatus, preferably a resilient blade urged against the roller, for removing the toner particles from the developer roller. Preferably the resilient blade is a metal blade having an insulating surface layer. In an alternative preferred embodiment of the invention, the resilient blade is made of polyester.

Further, in accordance with a preferred embodiment of the invention, there is provided imaging apparatus including:

an imaging surface;

apparatus for forming a latent image including image areas at a first electrical potential and background areas at a second electrical potential on the imaging surface; and developing apparatus for developing the latent image with a liquid toner including charged toner particles and a carrier liquid, the developing apparatus including:

(i) a developer roller electrified to a third electrical potential intermediate the first and second electrical potentials and having a portion thereof adjacent the imaging surface at a development region;

(ii) liquid toner supply means for supplying the liquid toner to the development region thereby developing the latent image, whereby toner particles are also attracted to the developer roller; and (iii) a resilient metal blade at least partially coated with an insulating coating, urged against said developer roller for removing the toner particles from the developer roller.

In accordance with a preferred embodiment of the invention the metal blade is at least partly coated with an insulating coating, preferably a coating of tetrafluoroethylene.

The insulating coating on the blades may be in the form of a segment or segments of adhesive tape or may be formed by dip or spray coating.

Further, in accordance with a preferred embodiment of the invention, there is provided imaging apparatus including:

an imaging surface;

apparatus for forming a latent image comprising image areas at a first electrical potential and background areas at a second electrical potential on the imaging surface; and apparatus for developing the latent image with a liquid toner including charged toner particles and a carrier liquid, the developing apparatus including:

(i) a developer roller at a third electrical potential intermediate the first and second electrical potentials, having a portion thereof adjacent the imaging surface at a development region;

(ii) liquid toner supply apparatus for supplying the liquid toner to the development region thereby developing the latent image, whereby toner particles are also attracted to the developer roller; and (iii) a resilient blade urged against said developer roller for removing the toner particles from the developer roller; and (iv) means for electrifying the resilient blade with a voltage, preferably a voltage of at least 500 volts, having the same polarity as that of the charge on the toner particles.

Further in accordance with a preferred embodiment of the invention, there is provided imaging apparatus comprising means for electrifying the resilient blade to a voltage of at least 500 Volts.

BRIEF DESCRIPTION OF THE DRAWINGS

The present invention will be understood and appreciated from the following detailed description, taken in conjunction with the drawings in which.

DETAILED DESCRIPTION OF PREFERRED EMBODIMENTS

Figure 1:
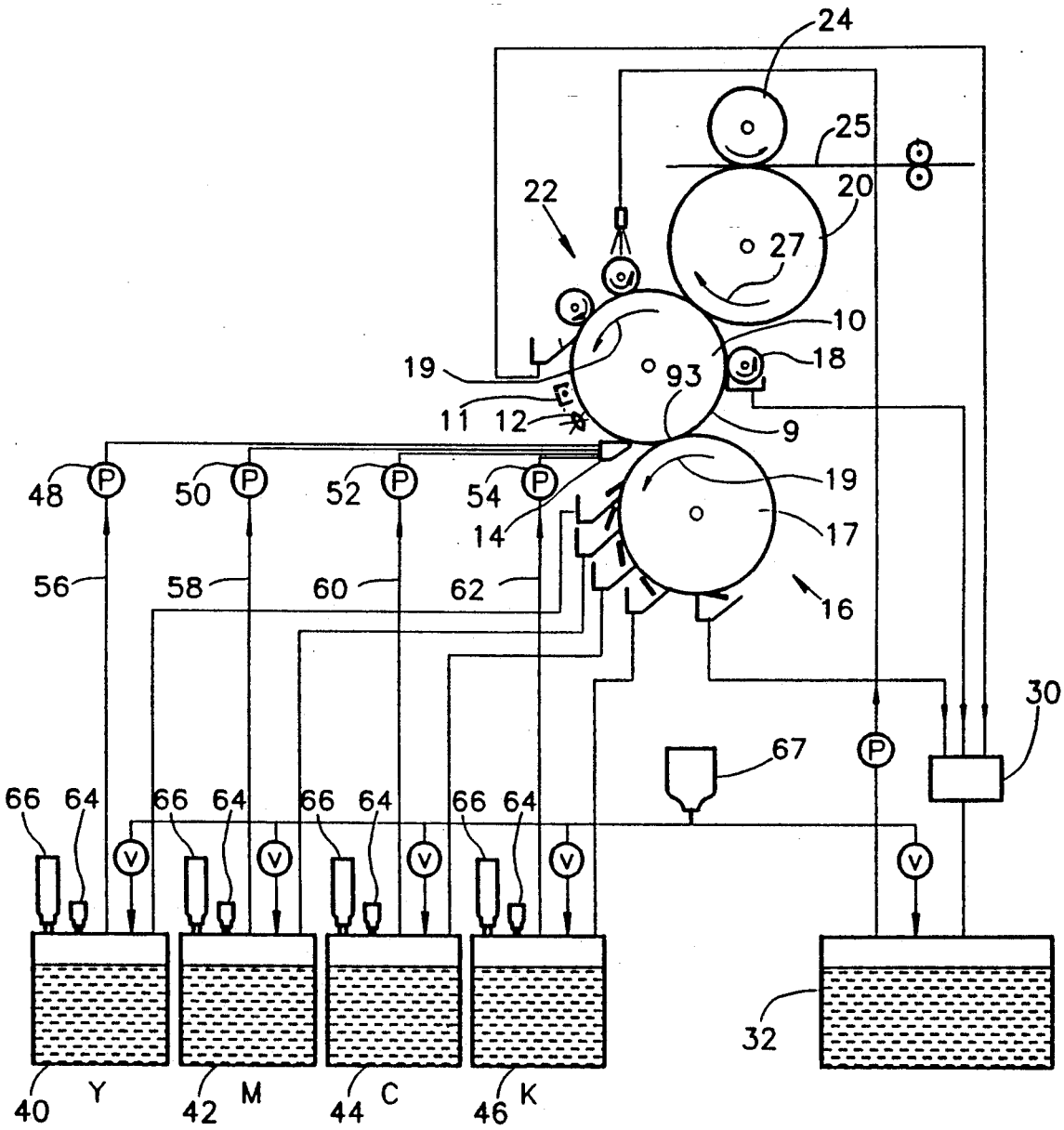
FIG. 1 is a schematic diagram illustrating electrostatic imaging apparatus in accordance with a preferred embodiment of the invention.

Reference is made to FIG. 1 which illustrates a multicolor electrostatic imaging system constructed and operative in accordance with a preferred embodiment of the present invention and including a rotation drum 10 having a photoconductive image bearing surface 9 of selenium or any other suitable photoconductor known in the art. Operatively associated with photoconductive drum 10 is charging apparatus 11, such as a corona ion source, which is operative to charge photoconductive surface 9 to a generally uniform predetermined voltage as drum 10 rotates past charging apparatus 11. Further rotation of drum 10 brings the charged photoconductive surface 9 opposite an imager 12. Imager 12, which may for example be a laser scanner, is operative to discharge selectively a portion of the charged photoconductive surface, by the action of incident light, thus forming thereon an electrostatic latent image including image areas at a first voltage and background areas at a second voltage.

As drum 10 rotates still further, photoconductive surface 9 bearing the electrostatic latent image, comes into propinquity with a roller developer electrode 17 forming a development region 93 therebetween. The latent image is developed at development region 93 by application thereto of liquid toner comprising charged toner particles and carrier liquid which is dispensed by liquid toner dispensing assembly 14. Developer roller electrode 17 is closely spaced from and typically rotates in the same sense as drum 10 as indicated by arrows 19. This rotation provides for the surfaces of drum 10 developer roller 17 to move with opposite velocities in their region of propinquity.

Developer roller 17 is electrified to a voltage intermediate the voltages on the background and image portions of the electrostatic latent image on photoconductive surface 9. As a result of the relative differences in voltage between the surface of roller 17 and the image and background portions of the latent image, toner particles adhere selectively to the image portions thereby developing the latent image. Similarly, toner particles are attracted to regions of the roller opposite background portions of the latent image.

Dispensing assembly 14 and developer roller 17 form part of developer assembly 16 which is discussed in detail below, in conjunction with FIG. 2.

A preferred type of toner for use with the present invention is that described in Example 1 of U.S. Pat. No. 4,794,651, the teachings of which are incorporated herein by reference. Other toners may alternatively be employed. For colored liquid developers carbon black is replaced by color pigments as is well known in the art.

After the latent image has been developed, photoconductive surface 9 is engaged by an excess liquid removal assembly 18, such as a squeegee roller urged against photoconductive surface 9, which serves to compact the toner image, remove carrier liquid therefrom and remove carrier liquid from the background areas on photoconductive surface 9. Excess liquid removal assembly 18 is formed preferably of resilient, slightly-conductive, polymeric material and is electrified to a voltage of several hundred to a few thousand volts of the same polarity as that of the toner particle charge.

Downstream of excess liquid removal assembly 18 there is provided a, preferably electrified, intermediate transfer member 20, in operative engagement with photoconductive surface 9. Various types of intermediate transfer members are known and are described, for example in U.S. Pat. No. 4,684,238, PCT Publication WO 90/04216 and U.S. Pat. No. 4,974,027, the disclosures of all of which are incorporated herein by reference. While a drum type intermediate transfer member is shown in FIGS. 1 and 2, the intermediate transfer member may also be of the belt type. Alternatively, in a preferred embodiment of the invention, the intermediate transfer member may be omitted and the image may be directly transferred to a final substrate.

Intermediate transfer member 20 rotates in a sense opposite that of drum 10, as shown by arrow 27, such that there is substantially zero relative motion between their respective surfaces where they are in contact. As both drum 10 bearing the developed latent image and intermediate transfer member 20 rotate, the developed toner image on photoconductive surface 9 is transferred to the surface of intermediate transfer member 20 mainly by electrophoretic transfer as is well known in the art.

After the developed latent image has been transferred from photoconductive surface 9 to intermediate transfer member 20 as described above, it is transferred, in a second transfer procedure, aided by heat and pressure, from intermediate transfer member 20 to a final substrate 25, such as a sheet of paper. Intermediate transfer member 20 is preferably associated with a pressure roller 24 for transfer of the image onto a further substrate 25, such as paper, preferably by heat and pressure.

After the developed toner image has been transferred from photoconductive surface 9 to intermediate transfer member 20, the photoconductive surface is engaged by a cleaning station 22 which may be any conventional cleaning station as is known in the art. A lamp (not shown) then removes any residual charge which may remain on the photoconductive surface. Drum 10 then returns to its starting position, ready for recharging and an additional imaging cycle.

Figure 2:
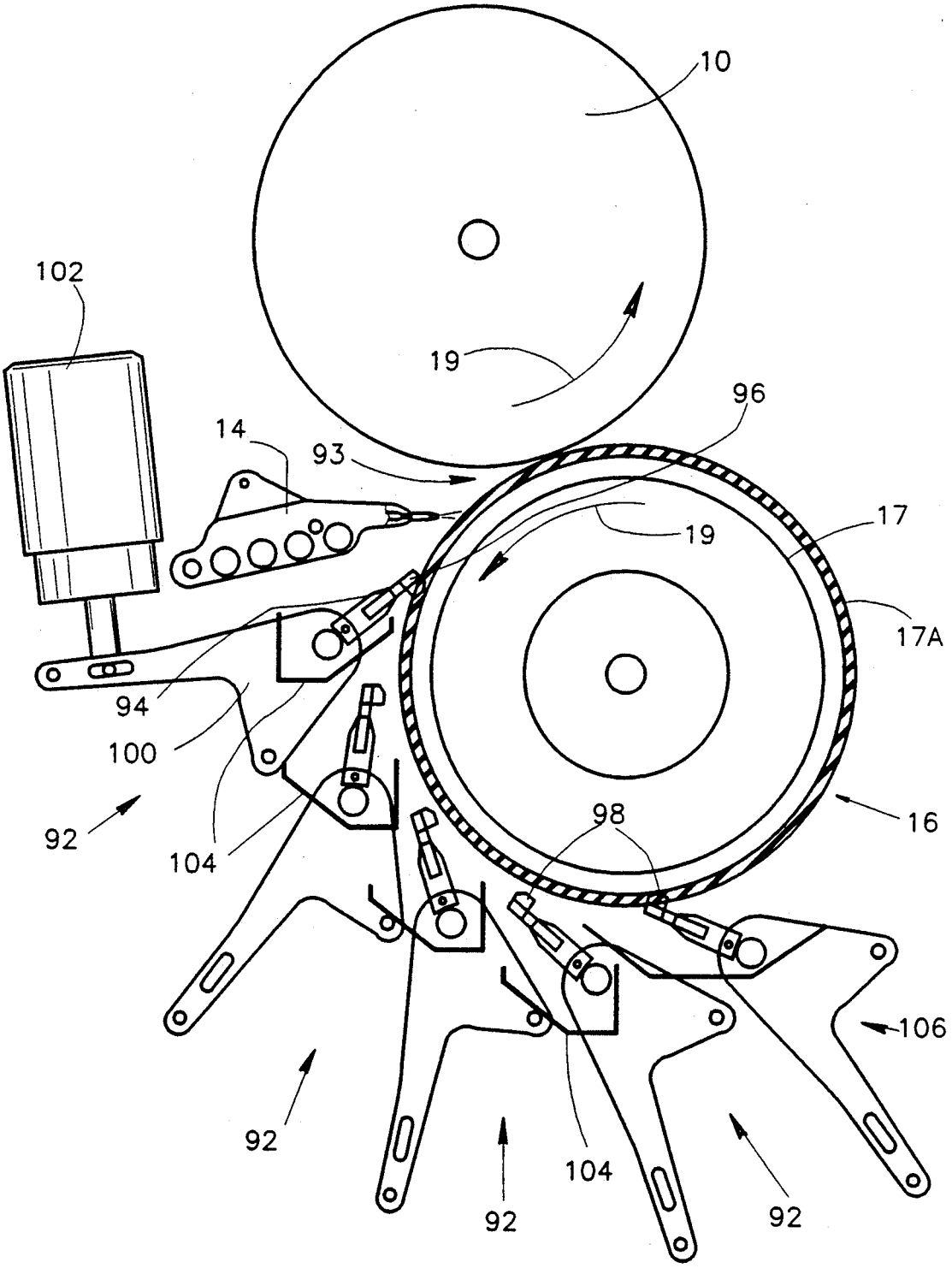
FIG. 2 is a cross-sectional illustration of part of the apparatus of FIG. 1 illustrating particularly a multicolor, non-contaminating liquid toner development assembly.

Reference is now made to FIG. 2 which illustrates a developer assembly 16 constructed and operative in accordance with a preferred embodiment of the invention. The developer assembly includes developer roller electrode 17 which is operatively associated with photoconductor drum 10. Associated with developer roller 17 are a plurality of color specific toner cleaning assemblies 92, each of which is brought selectably into operative association with the developer roller when toner of the color corresponding thereto is supplied to development region 93 by liquid toner dispensing assembly 14. In this way contamination by mixing of the various toner colors is prevented. Each of cleaning assemblies 92 comprises a resilient blade member 94 which when activated, is urged against the cylindrical surface of the rotating developer roller thereby diverting used liquid toner from the surface into used toner collection apparatus 104, for recycling to liquid toner dispensing assembly 14. In addition to blade member 94, each of cleaning assemblies 92 comprises side wiping portions 98 arranged to engage the two edges of the developer roller surface. Blade member 94 is mounted on a linkage now which is positioned selectably by a conventional actuator 102. Further details of developers of this type can be found in WO 90/14619 the disclosure of which is incorporated herein by reference.

As noted above, the toner collected by collection apparatus 104 is recycled to the respective toner reservoirs. A final toner collection assembly 106 always engages the developer roller 17. The toner collected thereat is supplied to a separator 30 (FIG. 1). Alternatively the toner collected by assembly 106 may be supplied directly to the black (K) toner reservoir 46.

Excess liquid, containing toner particles of various colors is collected from cleaning station 22, excess liquid removal assembly 18 (assembly 106) and supplied to separator 30 which is operative to separate relatively clean carrier liquid from the various colored toner particles. The separator may typically be of the type described in U.S. Pat. application 319,124, filed Mar. 6, 1989. Clean carrier liquid is supplied from separator 30 to a carrier liquid reservoir 32, which may also receive additional supplies of carrier liquid, as necessary. Carrier liquid from reservoir 32 is supplied to cleaning station 22.

It is seen in FIG. 1, that liquid toner dispensing assembly 14 receives separate supplies of colored toner from four different reservoirs 40, 42, 44 and 46, typically containing the colors Yellow, Magenta, Cyan and Black respectively. Pumps 48, 50, 52 and 54 may be provided along respective supply conduits 56, 58, 60 and 62 for providing a desired amount of pressure to feed the colored toner to assembly 14.

Associated with each of reservoirs 40, 42, 44 and 46 are typically provided containers of charge director and concentrated toner material, indicated respectively by reference numerals 64 and 66 as well as supply of carrier liquid indicated generally by reference number 67.

The inventors of the present invention have found that, generally, when undeveloped (used) liquid toner is removed from the developer roller, the toner particles tend to agglomerate and stick to the surfaces of the blades with consequent accretion of liquid toner residues usually referred to by the descriptive term "sludge". The effect is especially evident when metal blades are used for removal.

The inventors believe that, when metal blades are employed, toner particles in the liquid toner dispersion are at least partly discharged during contact with the blade surfaces. Thus, the normally present electrostatic forces of mutual repulsion between the particles of the dispersion are not operative or at least not very strong. Such repulsive forces are generally advantageous because they assist in maintaining a state of physical separation between the toner particles thereby aiding the prevention of coagulation and accretion of sludge. Sludge formation is characteristic of the preferred liquid toner since the particles thereof are formed with fibrous extensions which are conducive to the agglomeration of discharged particles.

Figure 3:
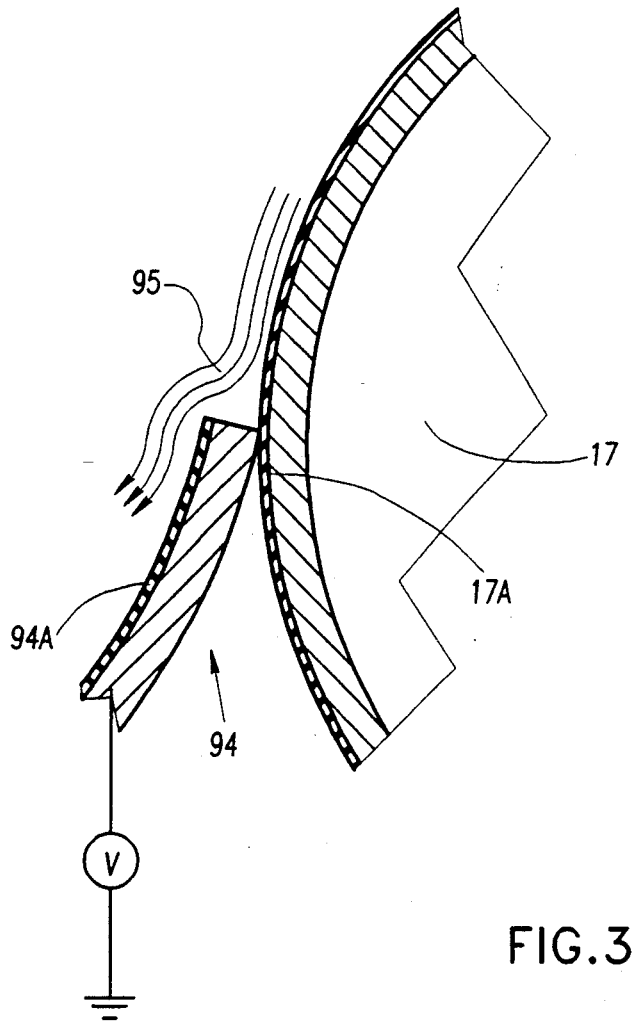
FIG. 3 is a schematic cross-sectional illustration of a preferred embodiment of the developing means of the present invention.

In a preferred embodiment of the invention, at least the upper surface portion of the blade, i.e. the major portion which comes into contact with the toner, is coated with a sludge preventing material. The tip of the blade, as shown in FIG. 3 is preferably left uncoated.

To determine the influence of blade surface material on sludge formation, trials of several types of blade having different dielectric and surface properties have been carried out as presented in the following non-limiting example.

EXAMPLE I

The following blades were evaluated:

(a) steel, uncoated;

(b) polyester blades;

(c) steel coated with a 10 micron layer of nitrocellulose;

(d) steel coated with a 100 micron layer of tetrafluoroethylene;

(e) steel coated with a 32 micron layer of polyimide (Kapton); and (f) steel coated with a 100 micron layer of polyimide (Kapton).

Reference is made to FIG. 3 which illustrates a resilient blade 94 urged against developer roller 17 as previously described. Also illustrated is a non-conducting coating 94A on the upper surface of the engaged blade over which used liquid toner 95 flows when removed from roller 17.

All coated blades were left uncoated at the working edge as illustrated in FIG. 3. The insulating coating on the blades may be in the form of a segment or segments of adhesive tape or may be formed by dip or spray coating.

Apparatus utilizing the respective blades were operated for a pre-determined period and then rated according to their efficiency in preventing accretion of sludge. The following list grades the blade types in order of increasing accumulation of residues:

1. Polyester;
2. Steel coated with 100 microns tetrafluoroethylene (TFE);
3. Steel coated with 100 microns Kapton;
4. Steel coated with 32 microns Kapton;
5. Steel coated with 10 microns nitrocellulose; and
6. Steel, uncoated.

The polyester and TFE coated blades were found to be entirely free of toner deposits throughout the duration of the trials. Thin uniform accretions of toner material were apparent on the Kapton and nitrocellulose coated blades, but were not deemed troublesome. Relatively thick accretions of sludge were observed on the uncoated steel blade.

The non-limiting examples cited above serve to demonstrate the advantages of the present invention. When, according to a preferred embodiment of the invention, the means for removal of toner particles from developer roller 17 comprises a metal blade 94 coated with an insulating material 94A as illustrated in FIG. 3, or is wholly of a non-conducting material conducive to preventing adhesion, sludge accumulations are avoided.

The results of the trials cited in Example I show that blades made of steel coated with TFE are relatively effective in preventing the build-up of toner residues on their surfaces. Such blades may be rendered even more effective when electrified to a voltage of the same polarity as the charge on the liquid toner particles. The repulsive electrostatic force exerted on the charged toner by the electrified blades serves to reject liquid toner particles contacting the blades and thereby reduces discharge of the particles and build-up of residues. Furthermore, it is found that the method is most effective when the absolute value of the voltages on the blades is at least 500 Volts.

As described in Example I above, uncoated steel blades performed worst of all in terms of prevention of sludge formation. However, use of the biasing method described above results in substantially reduced accumulation of residues even on uncoated steel blades. The relatively long wear life of metal blades (e.g. steel), when operating against the developer roller surface constitutes an added incentive for their deployment in the present application.

Configurations described above for limiting sludge build-up on blades are believed to be effective because they avoid discharge of particles of the undeveloped (used) liquid toner dispersion coming into contact with the blades. It is therefore preferable to ensure that the used liquid toner does not arrive at the blades in a discharged condition. Such a condition may occur if there is premature discharge of toner whilst being transported from development region 93 of FIG. 2 by developer roller 17 of FIG. 2.

In the prior art the surface of developer rollers is generally conductive, especially in systems which include apparatus for physically removing the used toner from the surface with resilient blades. Thus, the particles may be neutralized during transport on the surface of the developer roller.

To avoid discharge of the liquid toner particles until they are received by collection apparatus 104, the surface of the developer roller is preferably coated with a layer of non-conducting material 17A, as illustrated in FIG. 3. Furthermore when, as in the present invention, blades are deployed to remove used toner, it is preferable that the surface of the roller also be abrasion resistant.

When aluminum is used as the bulk material of the roller, a coating may be produced by anodizing the surface so as to form a porous aluminum oxide layer. Aluminum oxide layers are generally insulating and abrasion resistant. However, when used with a conducting liquid, anodizing does not yield a truly insulating layer since the pores of the anodized layer constitute pathways for electrical conduction to the bulk material of the roller. Liquid toner is an electrically conductive medium which, if allowed to access the pores of the anodized layer, will provide a conduction path to the bulk of the roller and allow the toner to become discharged. As used herein, the terms insulating layer and insulating coating mean a layer or coating which remain insulating in the presence of a conducting liquid.

In a preferred embodiment of the present invention, the insulating properties of the anodized surface are improved by impregnating of the surface with a material consisting essentially of a compound of a Group II or Group III metal with a long chain fatty acid, in accordance with the process given in U.S. Pat. No. 4,413,049, the disclosures of which are incorporated herein by reference.

The advantage of this method will be further apparent from the following non-limiting example.

EXAMPLE II

The developer roller is placed in a pre-heated furnace at 150° C. for a period of 4 hours in a vacuum. This treatment causes moisture to be driven off the surface of the roller. The hot roller is removed from the furnace and covered with zinc stearate powder which melts on contact with the hot roller. The zinc stearate is smoothed with a fabric cloth to ensure application of a relatively uniform layer. The roller is then replaced in the furnace for several minutes in a vacuum, removed again and allowed to cool to room temperature. Excess coating material is removed by wiping the surface with a fabric cloth. After cooling, the roller is polished using fine silicon carbide paper moistened with oil.

The following procedure is used to evaluate the effect of the impregnation process on the conductivity of the roller surface.

The roller is placed on a clean dry insulating surface. A 30 mm diameter disk of absorbent paper is placed in contact with the roller surface and a 20×40 mm patch of conductive copper tape attached to the disk to form an electrode. A nano-ammeter is connected in series to a 100 Volt supply in order to measure the current through the roller surface. This "dry" measurement, made on the impregnated and unimpregnated anodized surfaces of the roller, gives a current of 10 nA for both cases.

In a "wet" measurement the paper disk is wetted with isopropyl alcohol so as to provide improved electrical contact between the copper tape measuring electrodes and the metal of the roller bulk. Impregnation of the roller surface reduces the current flowing through the roller surface by a factor of 1500 viz. from 120,000 nA to 80 nA.

In order to evaluate the effectiveness of the above procedure a roller was prepared in which one axial half of the roller was coated as above, the other half having an ordinary anodized coating. It was found that there was substantially less accretion of toner residues on the blades of the cleaning assemblies for the treated half of the anodized layer than for the untreated half. It is believed that sludge formation is reduced by avoiding discharge used liquid toner particles during their transport by the developer roller. The treated developer roller was operated in the imaging system of the present invention with no discernible impairment of image quality compared to that obtained with an unanodized, unimpregnated developer roller.

An alternative preferred embodiment of the present invention provides a nitrocellulose layer, of approximate thickness 10 microns as an effective non-conducting coating on the developer roller. Such a coating is suitable for a developer roller made of electrically conducting material, irrespective of whether or not the material is aluminum.

It will be appreciated by persons skilled in the art that the present invention is not limited by what has been particularly shown and described hereinabove. Rather the scope of the present invention is defined only by the claims which follow:

What is claimed is:

1. Imaging apparatus comprising:

(a) an imaging surface having a latent image comprising image areas at a first electrical potential and background areas at a second electrical potential thereon; and (b) a developer comprising:

(i) a moving developer electrode electrified to a third electrical potential intermediate the first and second electrical potentials and having sequential surface portions thereof closely spaced from the imaging surface to form a development region therebetween, whereat the latent image is developed with liquid toner comprising carrier liquid and charged toner particles, whereby toner particles are also attracted to the developer surface; and (ii) a resilient metal blade urged against and in contact with the developer surface after it passes the development region and operative to remove toner particles from the developer surface, wherein the blade is coated with an insulating coating over at least a portion of the blade not contacting the developer surface and wherein the portion of the blade contacting the surface is not coated with the insulating coating.

2. Apparatus according to claim 1 wherein said resilient metal blade is covered with an insulating coating at least on those surfaces contacted by liquid toner.

3. Apparatus according to claim 1 wherein said insulating coating is formed of tetrafluoroethylene.

4. Apparatus according to claim 3 wherein the insulating coating is in the form of a segment or segments of an adhesive tape.

5. Apparatus according to claim 3 wherein said insulating coating is a surface layer formed by dip-coating.

6. Apparatus according to claim 1 further comprising means for electrifying said resilient metal blade with a voltage having the same polarity as that of the charge on the toner particles.

7. Apparatus according to claim 1 wherein the moving developer electrode is a roller developer electrode.

8. Apparatus according to claim 1 wherein the moving developer electrode is coated with an insulating layer.

9. Apparatus according to claim 8 wherein the insulating layer comprises a coating of anodized aluminum which has been treated to enhance its electrical insulation properties.

10. Apparatus according to claim 9 wherein the surface coating is impregnated with a material consisting essentially of a chemical compound of a Group II or Group III metal with a long chain fatty acid to enhance its electrical insulation properties.

11. Apparatus according to claim 8 wherein the insulating layer comprises a nitrocellulose coating.

12. Imaging apparatus comprising:

(a) an imaging surface having (b) a latent image comprising image areas at a first electrical potential and background areas at a second electrical potential thereon; and developer apparatus comprising:

(i) a moving developer electrode electrified to a third electrical potential intermediate the first and second electrical potentials, having sequential surface portions thereof adjacent the imaging surface at a development region whereat the latent image is developed with liquid toner comprising carrier liquid and charged toner particles, situated between the developer surface and the imaging surface, and whereby toner particles are also attracted to the developer electrode; and (ii) a resilient blade, electrified with a voltage having the same polarity as that of the charge on the toner particles, urged against the developer surface after it passes the development region and operative to remove toner particles from the developer surface.

13. Apparatus according to claim 12 wherein said voltage is at least 500 Volts.

14. Apparatus according to claim 12 wherein the moving developer electrode is a roller developer electrode.

15. Apparatus according to claim 12 wherein the moving developer electrode is coated with an insulating layer.

* * * * *